US005983641A

United States Patent [19]

Mandai et al.

[11] Patent Number: 5,983,641

[45] **Date of Patent: *Nov. 16, 1999**

[54] TAIL PIPE OF GAS TURBINE COMBUSTOR AND GAS TURBINE COMBUSTOR HAVING THE SAME TAIL PIPE

[75] Inventors: Shigemi Mandai; Tetsuo Gora; Satoshi Tanimura; Yoshichika Sato, all of Hyogo-ken, Japan

[73] Assignee: Mitsubishi Heavy Industries, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/846,579

[22] Filed: Apr. 30, 1997

[51] Int. Cl.[6] ..... F02C 3/14; F23R 3/42

[52] U.S. Cl. ..... 60/722; 60/752

[58] Field of Search ..... 60/39.32, 39.37, 60/722, 752

[56] References Cited

U.S. PATENT DOCUMENTS

| | | | |
|---|---|---|---|
| 3,657,883 | 4/1972 | DeCorso | 60/39.37 |
| 3,759,038 | 9/1973 | Scalzo et al. | 60/39.32 |
| 4,794,753 | 1/1989 | Beebe | 60/39.32 |
| 5,265,412 | 11/1993 | Bagepalli et al. | 60/39.32 |

FOREIGN PATENT DOCUMENTS

| | | |
|---|---|---|
| 61-170870 | 8/1986 | Japan . |
| 8-285284 | 11/1996 | Japan . |

OTHER PUBLICATIONS

English translation of the Japanese Patent Office Official Action for Patent Appl. No. 003862/1996 mailed Sep. 3, 1998.

*Primary Examiner*—Louis J. Casaregola
*Attorney, Agent, or Firm*—Alston & Bird LLP

[57] ABSTRACT

In a tail pipe of gas turbine combustor, the portion just in front of the outlet 104 of tail pipe of gas turbine combustor has a shape such as to be inclined with respect to the axial direction so that the direction changes from the rearward direction to the direction toward the rear in the substantially axial direction, and at this portion, the position of center of curvature 103 in the axial direction on the rotor side lies on the upstream side from the position of center of curvature 102 on the casing side, a bent portion of tail pipe serves as a suction duct, and the occurrence of a negative pressure zone is prevented. Also, by using the tail pipe, a combustor inner tube or a burner provided on the upstream side of the tail pipe having a straight or substantially straight axis is disposed so that the axis of the combustion inner tube or the burner makes an angle with respect to the axis of the tail pipe in such a manner that combustion gas collides with the back side of the tail pipe.

11 Claims, 4 Drawing Sheets

TAIL PIPE OF GAS TURBINE COMBUSTOR AND GAS TURBINE COMBUSTOR HAVING THE SAME TAIL PIPE

FIELD OF THE INVENTION AND RELATED ART STATEMENT

The present invention relates to a tail pipe of gas turbine combustor for letting combustion gas to flow from a combustor to a turbine.

FIG. 4 shows a conventional tail pipe 200 of gas turbine combustor. High-temperature combustion gas from a combustor (not shown) flows into a tail pipe 200 from a tail pipe inlet 101 as indicated by arrow a and flows to a turbine (not shown) from a tail pipe outlet 104. A portion just in front of the tail pipe outlet 104, which is a turbine inlet of the tail pipe 200, has a shape such as to be inclined with respect to the axial direction so that the direction changes from the rearward direction to the direction toward the rear in the substantially axial direction. At this portion, the center of curvature 202 of a casing-side wall surface (upper-side wall surface in FIG. 4) 201*a* and the center of curvature 203 of a rotor-side wall surface (lower-side wall surface in FIG. 4) 201*b* agree with each other, and these centers of curvature 202 and 203 are positioned on the casing side from the casing-side wall surface 201*a* as shown in FIG. 4(*a*), by which a bent duct is formed at this portion. The cross section of the tail pipe 200 at the upstream-side portion from this bent duct is circular as shown in FIG. 4(*b*), and the cross section of the tail pipe 200 at the downstream-side portion from the bent duct is of a fan shape as shown in FIG. 4(*c*).

On the downstream side of the bent duct just in front of the turbine inlet of the tail pipe 200 of gas turbine combustor, a negative pressure zone is produced in the casing-side region indicated by hatching, thereby generating a secondary flow 205 such that relatively low-temperature gas in the vicinity of a side wall 106 of the tail pipe 200 turns into the casing-side region of the tail pipe 200.

In the above-described conventional tail pipe 200 of gas turbine combustor, the secondary flow is produced on the downstream side of the bent portion in the vicinity of the tail pipe outlet 104, so that relatively low-temperature gas in the vicinity of the side wall 106*a* turns to the casing side of the tail pipe 200. As a result, the low-temperature zone on the tail pipe casing side expands, and a high-temperature zone is produced in the vicinity of the side wall 106. Thereupon, the gas temperature distribution at the gas turbine combustor outlet 104 is distorted, and the tail pipe wall temperature is made nonuniform.

OBJECT AND SUMMARY OF THE INVENTION

The present invention was made to provide a tail pipe of gas turbine combustor which can solve the above problems.

Accordingly, a first object of the present invention is to provide a tail pipe of gas turbine combustor, which can prevent the occurrence of a secondary flow at a tail pipe outlet, prevent relatively low-temperature gas in the vicinity of a side wall from turning to the casing side of the tail pipe, and make the gas temperature distribution at the combustor outlet and the tail pipe wall temperature uniform.

Also, a second object of the present invention is to provide a gas turbine combustor which can make the combustion gas temperature distribution uniform in the tail pipe on the upstream side of the tail pipe outlet and in a combustor inner tube connected to the upstream side of the tail pipe, and in turn can improve the temperature distribution of the whole combustor in addition of the above-described effects.

To achieve the above first object, in the tail pipe of gas turbine combustor in accordance with the present invention, the portion just in front of the turbine inlet has a shape such as to be inclined with respect to the axial direction so that the direction changes from the rearward direction to the direction toward the rear in the substantially axial direction, and at this portion, the position of center of curvature in the axial direction on the rotor side lies on the upstream side from that on the casing side.

By using such a configuration, the portion just in front of the turbine inlet of gas turbine combustor is of a shape of not a bent duct but a suction duct, so that a negative pressure zone is not produced on the casing side at the tail pipe outlet. Thereby, the production of a secondary flow from the tail pipe side wall to the casing side is prevented, so that the gas temperature distribution at the gas turbine combustor outlet is not distorted, and the tail pipe wall temperature is not made nonuniform.

Also, to achieve the above second object, the gas turbine combustor in accordance with the present invention uses the following configuration.

In a gas turbine combustor, comprising a burner, a combustor inner tube connected to the downstream side of the burner, and a tail pipe connected to the downstream side of the combustor inner tube, the tail pipe is so configured that the portion just in front of the turbine inlet has a shape such as to be inclined with respect to the axial direction of tail pipe so that the direction changes from the rearward direction to the direction toward the rear in the substantially axial direction of tail pipe, and at this portion, the position of center of curvature in the axial direction on the rotor side lies on the upstream side from that on the casing side, and the combustor inner tube or the burner provided on the upstream side of the tail pipe having a straight or substantially straight axis is disposed so that the axis of the combustion inner tube or the burner makes an angle with respect to the axis of the tail pipe in such a manner that combustion gas collides with the back side of the tail pipe.

Further, in the preferred embodiment of the present invention, the aforesaid angle is set at 3 to 5 degrees.

By using such a configuration, the secondary flow of combustion gas is produced in the combustor inner tube and the tail pipe, so that low-temperature gas at the outer peripheral portion is mixed with high-temperature gas at the central portion, by which the temperature distribution of combustion gas is made uniform. On the other hand, at the tail pipe outlet, the production of the secondary flow of combustion gas is prevented by the effect reverse to the above-mentioned effect, so that the temperature distribution of combustion gas is made uniform. By this synergistic effect, the temperature distribution of combustion gas can be made uniform more effectively.

BRIEF DESCRIPTION OF THE DRAWINGS

FIG. 1(*a*) is a longitudinal sectional view thereof, FIG. 1(*b*) is a cross-sectional view of a tail pipe inlet, and FIG. 1(*c*) is a cross-sectional view of a tail pipe outlet;

FIG. 4(*a*) is a longitudinal sectional view thereof, FIG. 4(*b*) is a cross-sectional view of a tail pipe inlet, and FIG. 4(*c*) is a cross-sectional view of a tail pipe outlet.

DETAILED DESCRIPTION OF PREFERRED EMBODIMENTS

Figure 1A:
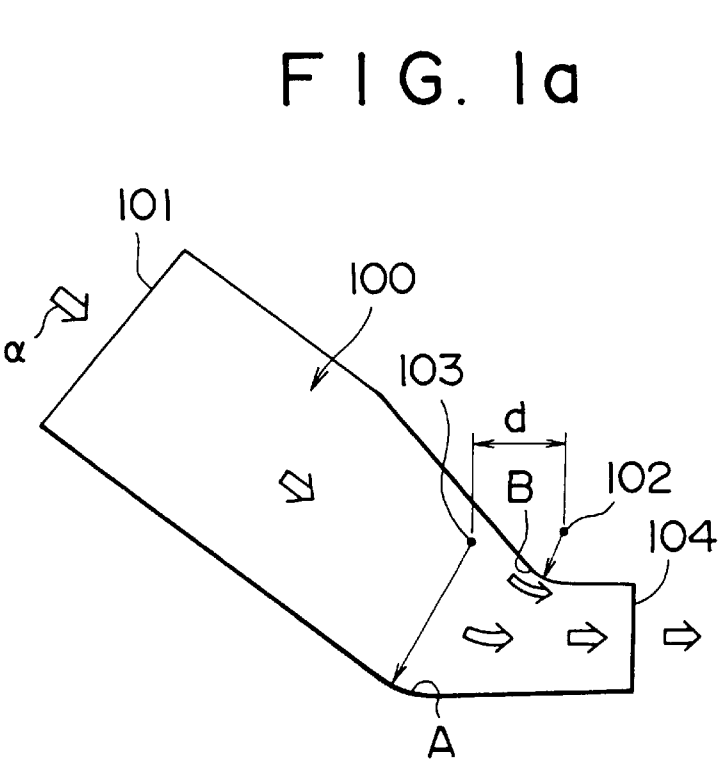
FIG. 1 shows a tail pipe in accordance with an embodiment of the present invention.

Embodiments of the present invention will be described with reference to FIGS. 1 to 3. A tail pipe of the embodiment is the same as the tail pipe of gas turbine combustor shown in FIG. 4 except for points described below, so that in FIGS. 1 to 3, the same reference numerals are applied to the same elements as those in FIG. 4, and the explanation of the elements is omitted.

Figure 1B:
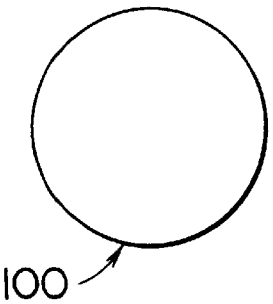
Figure 1C:
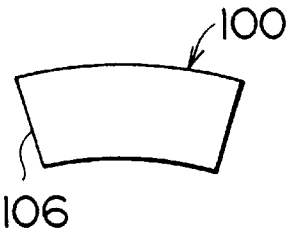

In this embodiment, as shown in FIG. 1(*a*), a tail pipe 100 is arranged just in front of a tail pipe outlet 104 through which combustion gas flows to a gas turbine. At the tail pipe portion having a shape such as to be inclined with respect to the axial direction so that the direction changes from the rearward direction to the direction toward the rear in the substantially axial direction, the center of curvature 103 of a rotor-side wall surface A is positioned at a distance d from the center of curvature 102 of a casing-side wall surface B on the upstream side. In FIG. 1(*a*), a turbine rotor (not shown) is disposed on the lower side of the tail pipe 100, and a casing (not shown) surrounding the gas turbine combustor is disposed on the upper side of the tail pipe 100.

In this embodiment, high-temperature combustion gas from the combustor (not shown) flows into the tail pipe 100 from a tail inlet 101 as indicated by arrow $\alpha$ and flows to the turbine through a tail pipe outlet 104. Since the center of curvature 103 of the tail pipe portion just in front of the tail pipe outlet 104, having a shape such as to be inclined with respect to the axial direction so that the direction changes from the rearward direction to the direction toward the rear in the substantially axial direction, is positioned at a distance d from the center of curvature 102 of a casing-side wall surface B on the upstream side, this portion serves as a suction duct, so that a negative pressure zone is not produced on the casing side of the tail pipe 100. Thereby, the production of the negative pressure zone on the casing side in the vicinity of the tail pipe outlet 104 is prevented, so that a secondary flow from a side wall 106 of the tail pipe 100 to the casing side is not generated. Therefore, the gas temperature distribution at the gas turbine combustor outlet 104 is not distorted, and the tail pipe wall temperature is not made nonuniform.

According to this embodiment, since the center of curvature on the rotor side of the portion just in front of the turbine, having a shape such as to be inclined with respect to the axial direction of the gas turbine combustor tail pipe so that the direction changes from the rearward direction to the direction toward the rear in the substantially axial direction, is positioned on the upstream side of the center of curvature on the casing side, the secondary flow is less prone to occur at the tail pipe outlet. Therefore, the distortion of gas temperature distribution at the gas turbine combustor outlet is prevented, and the tail pipe outlet wall temperature can be made uniform.

Figure 2:
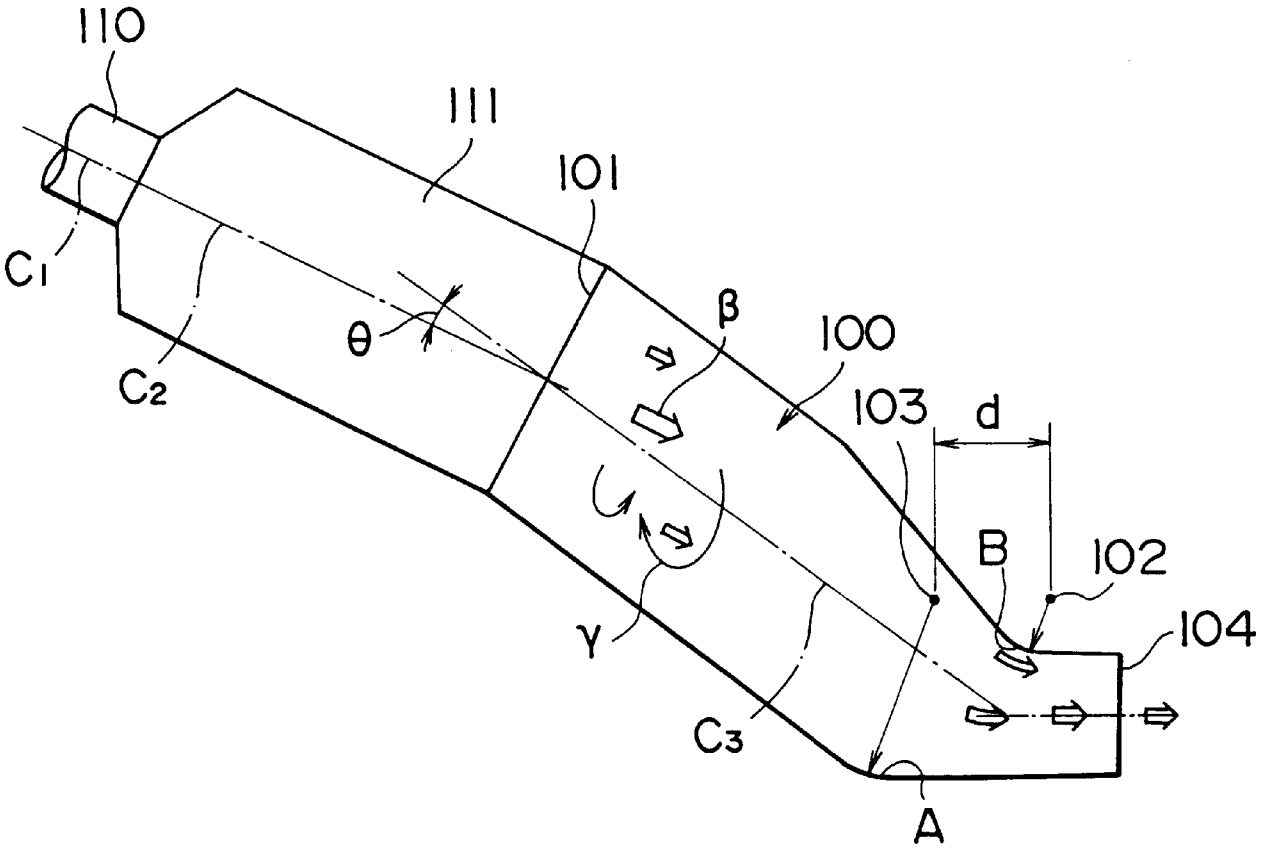
FIG. 2 is a view showing a configuration of a gas turbine combustor having the tail pipe shown in FIG. 1.

FIG. 2 shows a gas turbine combustor in accordance another embodiment of the present invention. The gas turbine combustor of this embodiment has a tail pipe 100 shown in FIG. 1. A combustor inner tube 111 is connected to the upstream side of the tail pipe 100, and a burner 110 is connected to the upstream side of the combustor inner tube 111. The gas turbine combustor of this embodiment is adapted to improve the flow of combustion gas in the combustor inner tube 111 and the tail pipe 100 by combining the combustor inner tube 111 and the burner 110 with the tail pipe 100 shown in FIG. 1.

Specifically, the tail pipe 100 has a shape with a cross section decreasing gradually from the upstream side to the downstream side, and is formed into a conical shape having a straight axis as shown in FIG. 2. The cylindrical combustor inner tube 111 having the burner 110 is connected to the upstream side of the tail pipe 100. The burner 110 is provided on the upstream side of the combustor inner tube 111, and the burner 110 and the combustor inner tube 111 are arranged so that the axes $C_1$ and $C_2$ thereof are coaxial. The axis $C_2$ of the combustor inner tube 111 makes an angle $\theta$ with respect to the axis $C_3$ of the tail pipe 100. This angle $\theta$ should preferably be 3 to 5 degrees.

The portion just in front of a tail pipe outlet 104, which is a turbine inlet of the tail pipe 100, has a shape such as to be inclined with respect to the axial direction so that the direction changes from the rearward direction to the direction toward the rear in the substantially axial direction. As in the case of FIG. 1, at this bent duct portion, the center of curvature 103 of a rotor-side (lower-side in FIG. 2) wall surface A is positioned at a distance d from the center of curvature 102 of a casing-side (upper-side in FIG. 2) wall surface B on the upstream side.

In this case, the fuel supplied from the burner 110 is burned in the combustor inner tube 111, and the combustion gas passes through the tail pipe 100, flowing to a turbine through the tail pipe outlet 104. Since the axis $C_2$ of the combustor inner tube 111 makes an angle $\theta$ (preferably 3 to 5 degrees) with respect to the axis $C_3$ of the tail pipe 100, combustion gas leaving the combustor inner tube 111 collides with the back side (upper side in FIG. 2) of the tail pipe 100 as indicated by arrow $\beta$, so that the pressure in this region increases. At the same time, a region having a low flow velocity and low pressure is formed on the belly side (lower side in FIG. 2) of the tail pipe 100. The pressure difference between these regions produces a secondary flow in the cross section of the tail pipe 100 as indicated by arrow $\gamma$. Thereby, low-temperature gas at the outer peripheral portion in the tail pipe 100 is mixed with high-temperature gas at the central portion, so that the gas distribution is improved and made uniform.

The combustion gas having a uniform temperature distribution flows to the downstream side of the tail pipe 100, and the flow thereof is converted into the axial direction at the bent duct portion just in front of the tail pipe outlet 104. At this time, since the center of curvature 103 of the rotor-side wall surface A is positioned at a distance d from the center of curvature 102 of the casing-side wall surface B on the upstream side, this portion serves as a suction duct, so that a negative pressure zone is not produced on the casing side of the tail pipe 100. Thereby, the production of the negative pressure zone on the casing side in the vicinity of the tail pipe outlet 104 is prevented, so that the gas temperature distribution at the gas turbine combustor outlet 104 is not distorted, and the tail pipe wall temperature is not made nonuniform.

As a result, the uniform combustion gas flows into the turbine portion on the downstream side, so that the damage to a turbine blade due to the nonuniformity of combustion gas, especially high-temperature gas, is prevented.

Figure 3:
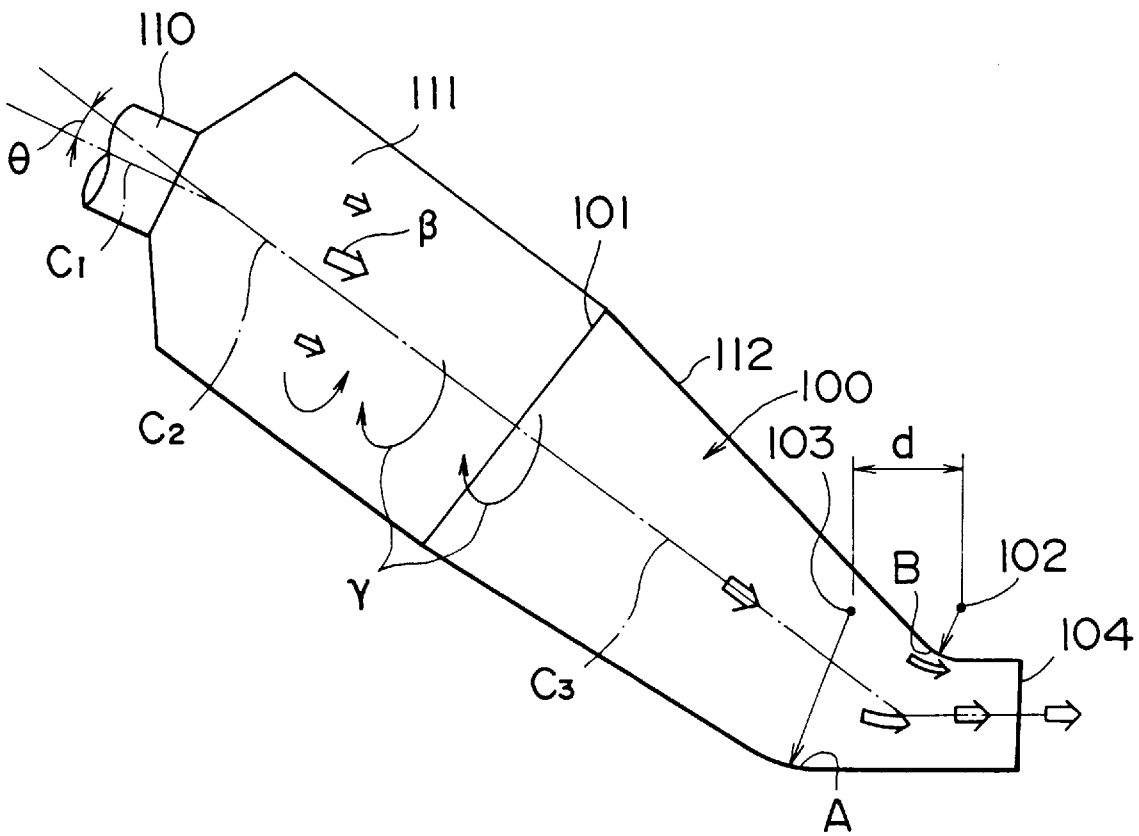
FIG. 3 is a view showing a configuration of another gas turbine combustor having the tail pipe shown in FIG. 1.
Figure 4B:
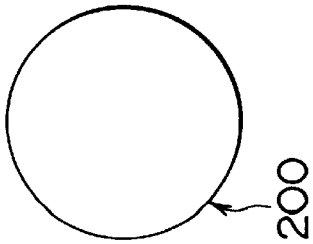
FIG. 4b RELATED ART
FIG. 4 shows a conventional tail pipe of gas turbine combustor.
Figure 4A:
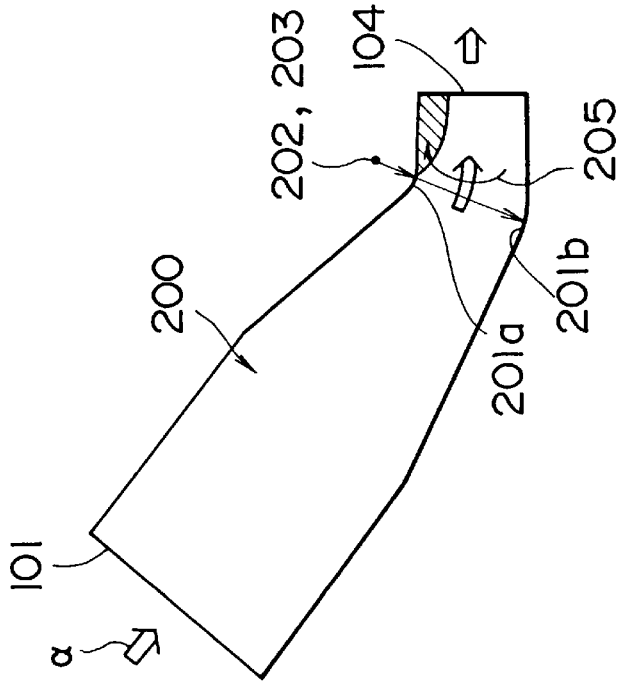
FIG. 4a RELATED ART
Figure 4C:
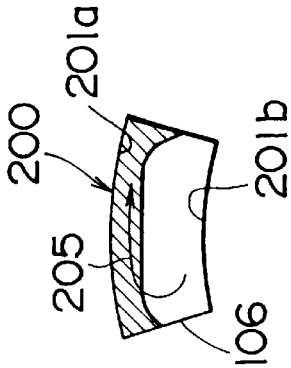
FIG. 4c RELATED ART

FIG. 3 shows a gas turbine combustor in accordance with still another embodiment of the present invention. Unlike the gas turbine combustor shown in FIG. 2, a conical tail pipe 100 having a cross section decreasing gradually on the downstream side and a straight axis and a cylindrical combustor inner tube 111 connected to the upstream side of the tail pipe 100 are arranged so that the axes $C_1$ and $C_2$ thereof are coaxial, and the axis $C_1$ of a burner 110 provided on the upstream side of the combustor inner tube 111 makes an angle θ (preferably 3 to 5 degrees) with respect to the axes $C_2$ an $C_3$ of the combustor inner tube 111 and the tail pipe 100, respectively.

As described above, since the axis $C_1$ of the burner 110 provided on the upstream side of the combustor inner tube 111 makes an angle θ with respect to the axes $C_2$ an $C_3$ of the combustor inner tube 111 and the tail pipe 100, respectively, the combustion gas generated in the combustor inner tube 111 by the fuel and air supplied from the burner 110 flows as indicated by arrow β and collides with the back side (upper side in FIG. 3) of the combustor inner tube 111 and the tail pipe 100.

Therefore, as explained with reference to FIG. 2, a secondary flow is produced in the cross section of the combustor inner tube 111 and the tail pipe 100 as indicated by arrow γ, so that low-temperature gas at the outer peripheral portion is mixed with high-temperature gas at the central portion, and the gas temperature is made uniform. The uniform gas flows toward a tail pipe outlet 104. Just in front of the tail pipe outlet 104, as in the case described above, the shape is such as to be inclined with respect to the axial direction so that the direction changes from the rearward direction to the direction toward the rear in the substantially axial direction, and at this bent duct portion, the center of curvature 103 of the rotor-side wall surface A is positioned at a distance d from the center of curvature 102 of the casing-side wall surface B on the upstream side, so that this portion serves as a suction duct, and a negative pressure zone is not produced on the casing side of the tail pipe 100. Therefore, the gas temperature distribution at the gas turbine combustor outlet 104 is not distorted, and the tail pipe wall temperature is not made nonuniform.

As a result, the uniform combustion gas flows into a turbine portion on the downstream side, so that the damage to a turbine blade is prevented.

As described with reference to FIGS. 2 and 3, since the portion just in front of the turbine has a shape such as to be inclined with respect to the axial direction of the tail pipe 100 of the gas turbine combustor described in FIG. 1 so that the direction changes from the rearward direction to the direction toward the rear in the substantially axial direction, and at this portion, the position of center of curvature in the axial direction of that portion on the rotor side lies on the upstream side from that on the casing side, the secondary flow is less prone to occur at the tail pipe outlet, so that the distortion of temperature distribution at the tail pipe outlet is prevented, and the tail pipe outlet wall temperature is made uniform. In addition, low-temperature gas at the outer peripheral portion is mixed with high-temperature gas at the central portion by the secondary flow formed in the upstream tail pipe or in the tail pipe and combustor inner tube, whereby the gas temperature distribution in the cross section of tail pipe is made uniform. The highest gas temperature is decreased, and the lowest gas temperature is increased, so that the gas having a desirable temperature distribution can be supplied to the turbine portion.

According to the gas turbine combustor shown in FIGS. 2 and 3, respectively, the secondary flow of combustion gas is produced in the combustor inner tube and the tail pipe, and on the other hand, the occurrence of the secondary flow of combustion gas at the bent portion formed just in front of the tail pipe outlet 104 is prevented, so that by this synergistic effect, the temperature distribution of combustion gas can be made uniform more effectively.

We claim:

1. A tail pipe of a gas turbine combustor that generates combustion gas for a turbine of the type having a rotor within a casing, the tail pipe comprising:

an outlet tail pipe section for supplying the combustion gas to the rotor, wherein said outlet tail pipe section extends in an axial direction;

an upstream tail pipe section that is upstream from said outlet tail pipe section, wherein said upstream tail pipe section extends in an axial direction that defines an angle with respect to said axial direction of said outlet tail pipe section; and a bent tail pipe section connected between said outlet tail pipe section and said upstream tail pipe section, said bent tail pipe section comprising:

a first side wall for being oriented toward the rotor, said first side wall defining a center of curvature, and a second side wall opposite from said first side wall and for being oriented toward the casing, said second side wall defining a center of curvature that is positioned downstream from said center of curvature of said first side wall.

2. A combustor for providing combustion gas to a gas turbine of the type having a rotor within a casing, the combustor comprising:

a burner; and a tail pipe in fluid communication with and downstream from said burner, said tail pipe comprising a first side wall for being oriented toward the rotor and a second side wall opposite from said first side wall and for being oriented toward the casing, said side walls cooperating to define an upstream tail pipe section in fluid communication with and downstream from said burner, a bent tail pipe section connected to and downstream from said upstream tail pipe section, and an outlet tail pipe section connected to and downstream from said bent tail pipe section, wherein said outlet tail pipe section extends in an axial direction and is for supplying the combustion gas to the rotor, said upstream tail pipe section extends in an axial direction that defines an angle with respect to said axial direction of said outlet tail pipe section, and in said bent tail pipe section:

said first side wall defines a center of curvature, and said second side wall defines a center of curvature that is positioned downstream from said center of curvature of said first side wall.

3. The combustor of claim 2, wherein said burner extends in an axial direction that defines an angle with respect to said axial direction of said upstream tail pipe section, so that the combustion gas collides with said second side wall.

4. The combustor of claim 3, wherein said angle defined between said axial direction of said burner and said axial direction of said upstream tail pipe section is in the range of 3 to 5 degrees.

5. The combustor of claim 3, further comprising an inner tube connected between said burner and said upstream tail pipe section.

6. The combustor of claim 5, wherein said inner tube and said burner are coaxial.

7. The combustor of claim 5, wherein said inner tube and said upstream tail pipe section are coaxial.

8. The combustor of claim 7, wherein said angle defined between said axial direction of said burner and said axial direction of said upstream tail pipe section is in the range of 3 to 5 degrees.

9. The combustor of claim 2, further comprising an inner tube connected between said burner and said upstream tail pipe section, wherein said inner tube extends in an axial direction that defines an angle with respect to said axial direction of said upstream tail pipe section, so that the combustion gas collides with said second side wall.

10. The combustor of claim 9, wherein said angle defined between said axial direction of said inner tube and said axial direction of said upstream tail pipe section is in the range of 3 to 5 degrees.

11. The combustor of claim 10, wherein said inner tube and said burner are coaxial.

* * * * *